US007434273B2

(12) United States Patent
Chung

(10) Patent No.: US 7,434,273 B2
(45) Date of Patent: Oct. 14, 2008

(54) EASY ACCESS DRYNESS ENHANCED MEN'S UNDERGARMENT

(75) Inventor: Chi Ki Victor Chung, Manhasset Hills, NY (US)

(73) Assignee: Nimbus Impression, Inc., Manhasset Hills, NY (US)

( * ) Notice: Subject to any disclaimer, the term of this patent is extended or adjusted under 35 U.S.C. 154(b) by 112 days.

(21) Appl. No.: 11/444,014

(22) Filed: May 31, 2006

(65) Prior Publication Data

US 2007/0277284 A1 Dec. 6, 2007

(51) Int. Cl.
*A41B 9/02* (2006.01)

(52) U.S. Cl. ..... 2/403; 2/78.1

(58) Field of Classification Search ..... 2/236, 2/237, 227, 228, 403, 400; 602/67–69; 66/177
See application file for complete search history.

(56) References Cited

U.S. PATENT DOCUMENTS

| | | | | | |
|---|---|---|---|---|---|
| 2,328,953 | A | * | 9/1943 | Chatfield et al. | 602/67 |
| 2,369,773 | A | * | 2/1945 | Brenner | 2/403 |
| 2,601,602 | A | * | 6/1952 | Firsching, Sr. | 602/67 |
| 3,207,155 | A | * | 9/1965 | Casey | 602/67 |
| 4,554,685 | A | | 11/1985 | Ray | |
| 4,660,551 | A | | 4/1987 | Nishimura | |
| 4,702,239 | A | | 10/1987 | Ichikawa | |
| 4,759,355 | A | * | 7/1988 | Thrower | 602/67 |
| 4,961,419 | A | | 10/1990 | Tribble | |
| 5,029,345 | A | | 7/1991 | Angheluta | |
| 5,070,869 | A | * | 12/1991 | Zhang | 602/67 |
| 5,226,179 | A | * | 7/1993 | Choi | 2/403 |
| 5,283,912 | A | * | 2/1994 | Chung | 2/403 |
| 5,524,298 | A | | 6/1996 | Plunktett | |
| 5,598,587 | A | | 2/1997 | Wada | |
| 5,647,065 | A | * | 7/1997 | Richerson | 2/403 |
| 5,678,250 | A | | 10/1997 | Nolan | |
| 5,870,779 | A | * | 2/1999 | Heron | 2/403 |
| 5,875,495 | A | * | 3/1999 | Thrower | 2/403 |
| 5,920,914 | A | * | 7/1999 | Dempsey | 2/403 |
| 6,061,840 | A | | 5/2000 | Alligator | |
| 6,243,880 | B1 | | 6/2001 | Lyden | |
| 6,353,940 | B1 | | 3/2002 | Lyden | |
| 6,662,378 | B2 | | 12/2003 | Vartanyan | |
| 6,862,746 | B2 | | 3/2005 | Cym | |
| 6,901,607 | B1 | | 7/2005 | Elwell | |
| 2002/0053102 | A1 | | 5/2002 | Vartanyan | |
| 2004/0025218 | A1 | * | 2/2004 | Huang | 2/73 |
| 2004/0231034 | A1 | | 11/2004 | Cym | |
| 2005/0235399 | A1 | | 10/2005 | Kang | |
| 2005/0268380 | A1 | | 12/2005 | Sovell | |
| 2007/0277285 | A1 | * | 12/2007 | Gravette et al. | 2/78.1 |

FOREIGN PATENT DOCUMENTS

| | | | |
|---|---|---|---|
| GB | 2060356 | A * | 5/1981 |
| JP | 06008839 | | 1/1994 |

* cited by examiner

*Primary Examiner*—Gary L Welch
*Assistant Examiner*—Richale L Quinn
(74) *Attorney, Agent, or Firm*—Allan Chan; Allan Chan & Assoc

(57) ABSTRACT

A male undergarment having a scrotum receiving cradle with an internal opening defined therein, in which the penis extends through resting in a penis enclosure. The outer penis enclosure connected to the crotch section of the tubular body portion, thereby forming a pocket with the front area of the tubular body portion. Said penis enclosure is canopied by fabric allowing the penis to be concealed no matter what state, additionally, allowing comfortable, access for left or right handed users.

25 Claims, 6 Drawing Sheets

EASY ACCESS DRYNESS ENHANCED MEN'S UNDERGARMENT

BACKGROUND OF THE INVENTION

This invention relates to a male undergarment. The garments developed in the past have attempted to provide relief to the wearer in the area of health protection; however, they have not adequately provided means for gently supporting and separating the penis and scrotum while providing a layer of fabric as an aid to perspiration control, protecting from the effects of the disorders of heat rash and/or herpes or the reduced sperm. Some prior art undergarments have attempted to solve the health-related problem concerning proper air circulation to the genitals of the wearer; however, the majority, for the most part, inhibit air circulation. The current invention addresses also the unsolved need of the difficulty in accessing the penis for urination

BRIEF SUMMARY OF THE INVENTION

A male undergarment having a scrotum receiving cradle with an internal opening defined therein, in which the penis extends through resting in a penis enclosure. The outer penis enclosure connected to the crotch section of the tubular body portion, thereby forming a pocket with the front area of the tubular body portion. Said penis enclosure is canopied by fabric allowing the penis to be concealed no matter what state, additionally, allowing comfortable, access for left or right handed users, no matter the number of outer layers of clothing.

OBJECTIVES OF THE INVENTION

Essentially the object of this invention to provide a male undergarment or swim wear having a construction that is intended to separate the penis from the scrotum, provide a high degree of comfort to the wearer, by preventing excess heat and the excess perspiration experienced in this area and retained from the nature of the body.

It is another objective of the present invention to provide a male undergarment which both covers and supports a wearer's penis in any state. The penis is supported by the bottom seam of the penis enclosure once in the flaccid state. Additionally, the penis is always concealed with the penis enclosure and penis enclosure flap which canopies the penis. Retainers are attached to the enclosure and the flap to ensure the positioning of the penis and prevent unintentional exposure. The retainers are flexible allowing the penis to be comfortable no matter in which state, flaccid or erect. The opening on the enclosure is horizontal allowing ease of access by either left handed or right handed individuals. The retainers allowing sufficient give to enable ease or access for urination.

It is yet another objective of the present invention to provide an undergarment which simultaneously provides health protection, support, comfort, and privacy without a radical departure from the customary appearance of a brief.

Yet still another objective of the present invention is to provide a penis support as well as scrotum support for the comfort of the wearer.

Yet another objective of the present invention is to provide a male undergarment in a variety of sizes and styles with sufficiently suitable materials to allow air circulation to such areas such as the penis and scrotum.

Finally due to separate support features for the penis and the scrotum, unlike the prior art, the elastic on the leg openings may be relaxed. Additionally, with the relaxed elastic around the legs, air circulation improved or facilitated to the affected areas. Thus this invention can take the form of either boxer, brief or any type of swim wear.

DETAILED DESCRIPTION OF THE INVENTION

Figure 1:
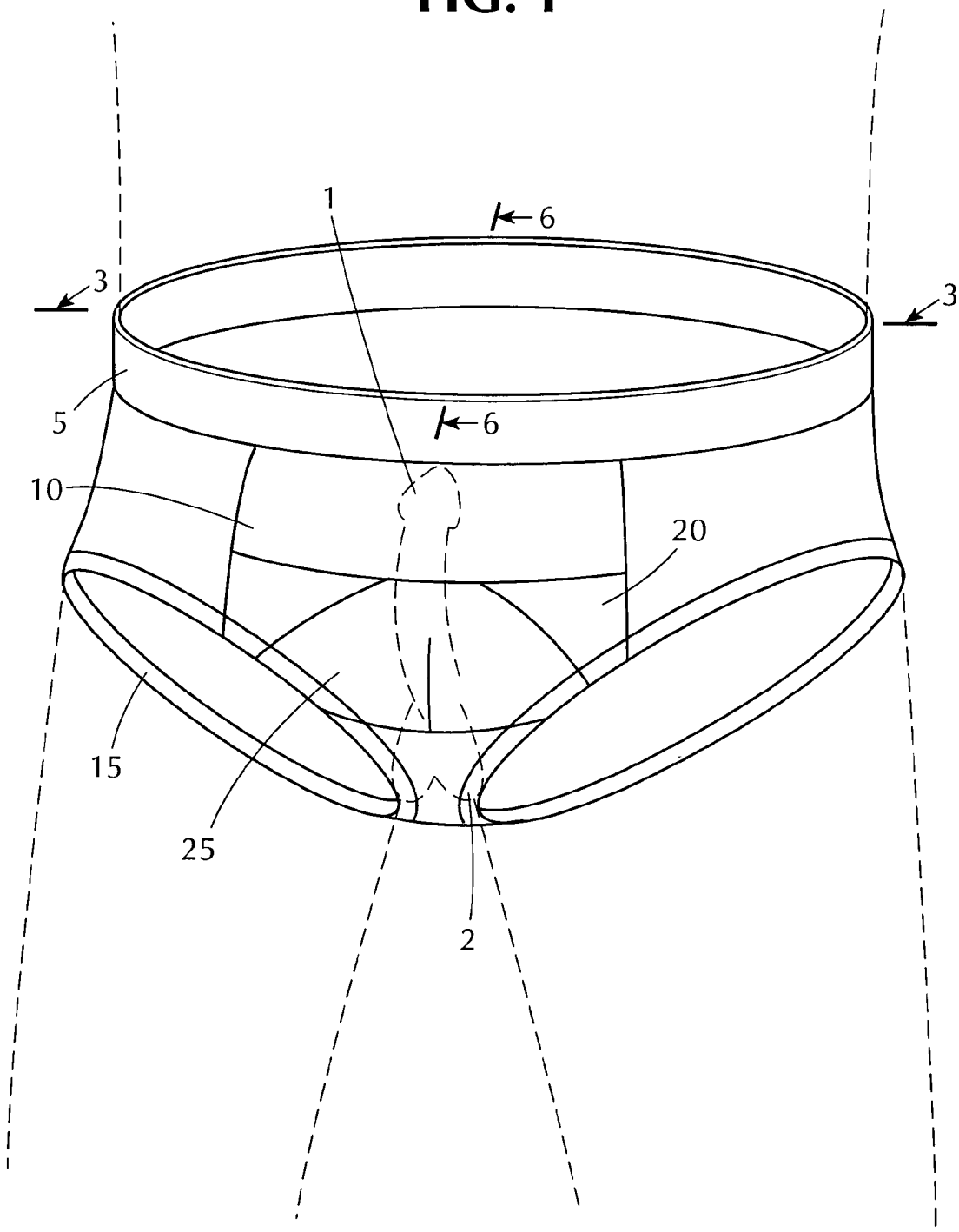
FIG. 1 is a front of the tubular body portion of the present invention illustrating the penis enclosure flap, flap retainers, penis enclosure, waistband, and two leg bands.
Figure 6:
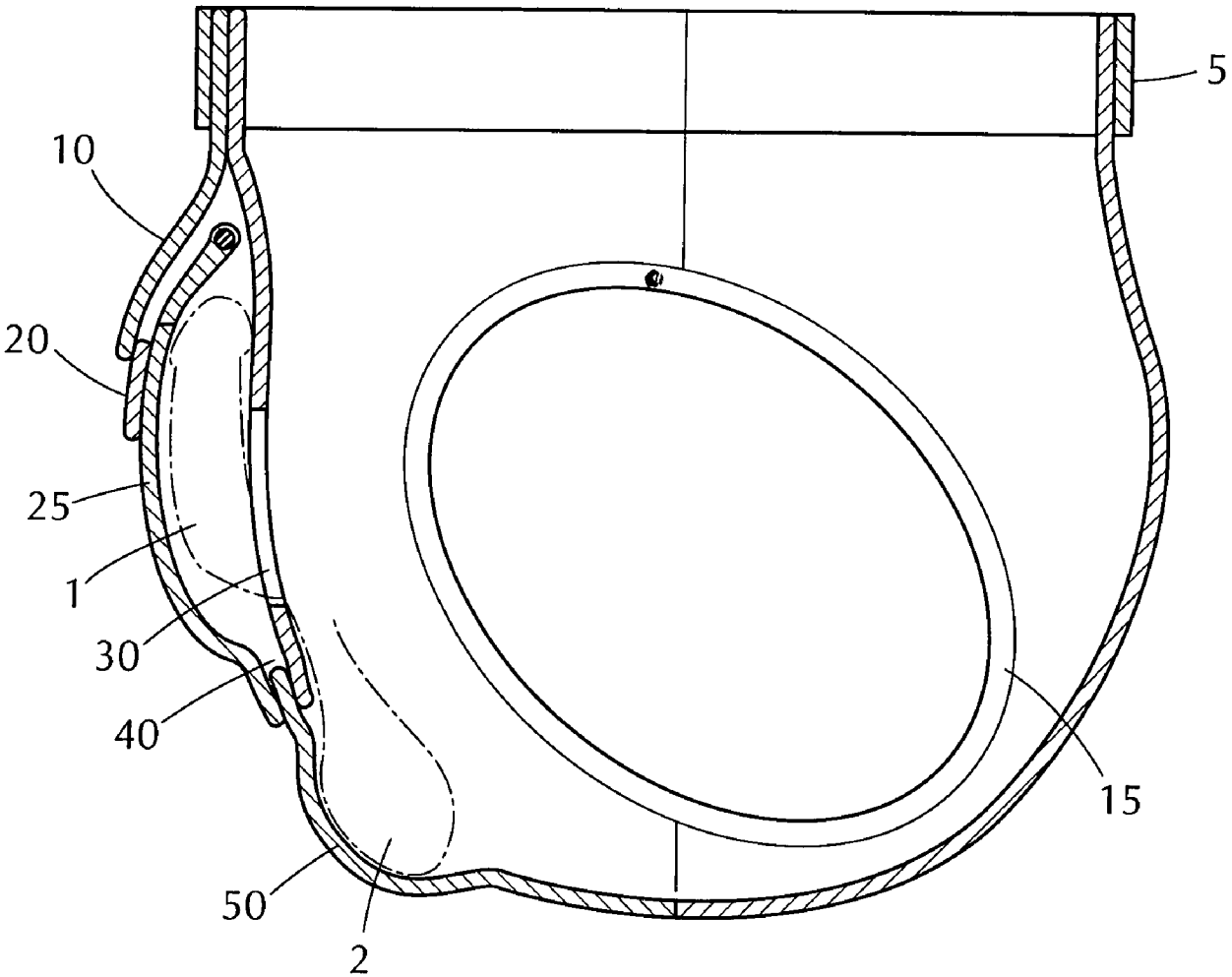
FIG. 6 is a side view of the garment illustrating the penis placed through the port within the penis enclosure additionally concealed with the penis enclosure flap with the scrotum separated from the penis in its own scrotum receiving cradle.

As shown in FIG. 1, a male undergarment or swimwear shown generally of several elements. The main elements of the preferred embodiment is a tubular body portion shown generally as 45, a penis enclosure 25, a penis enclosure flap 10, enclosure retainers, and flap enclosure retainers as shown in FIG. 1. The tubular body portion 45 has a front, a back, a crotch area, a leg band 15 and waistband 5 as commonly known in the art. In the preferred embodiment the front area of the tubular body has a penis enclosure 25 and enclosure flap forming a opening defined therein. A waistband 5 encircles the upper perimeter of tubular body 45 to encircle securely the waist or hip of the wearer and hold the garment in a relatively fixed position during use. Tubular body portion 45 can seamless tubular member snugly encircling the torso of the wearer. Where, however, garments are made in varying sizes, it is sometimes necessary to reduce or enlarge the diameter of the overall tubular body, including enlarged proportioned waistband 5, and leg bands 15. Tubular body portion 45 also includes a pair of leg-receiving openings, with leg bands 15 and in a generally tubular condition to provide for the formation of the crotch area, which may be in the form of a scrotum receiving cradle as shown in FIG. 6. In another embodiment, the body of the invention can be in a form of a boxer, brief, bikini brief, swim trunk, or bikini.

Figure 4:
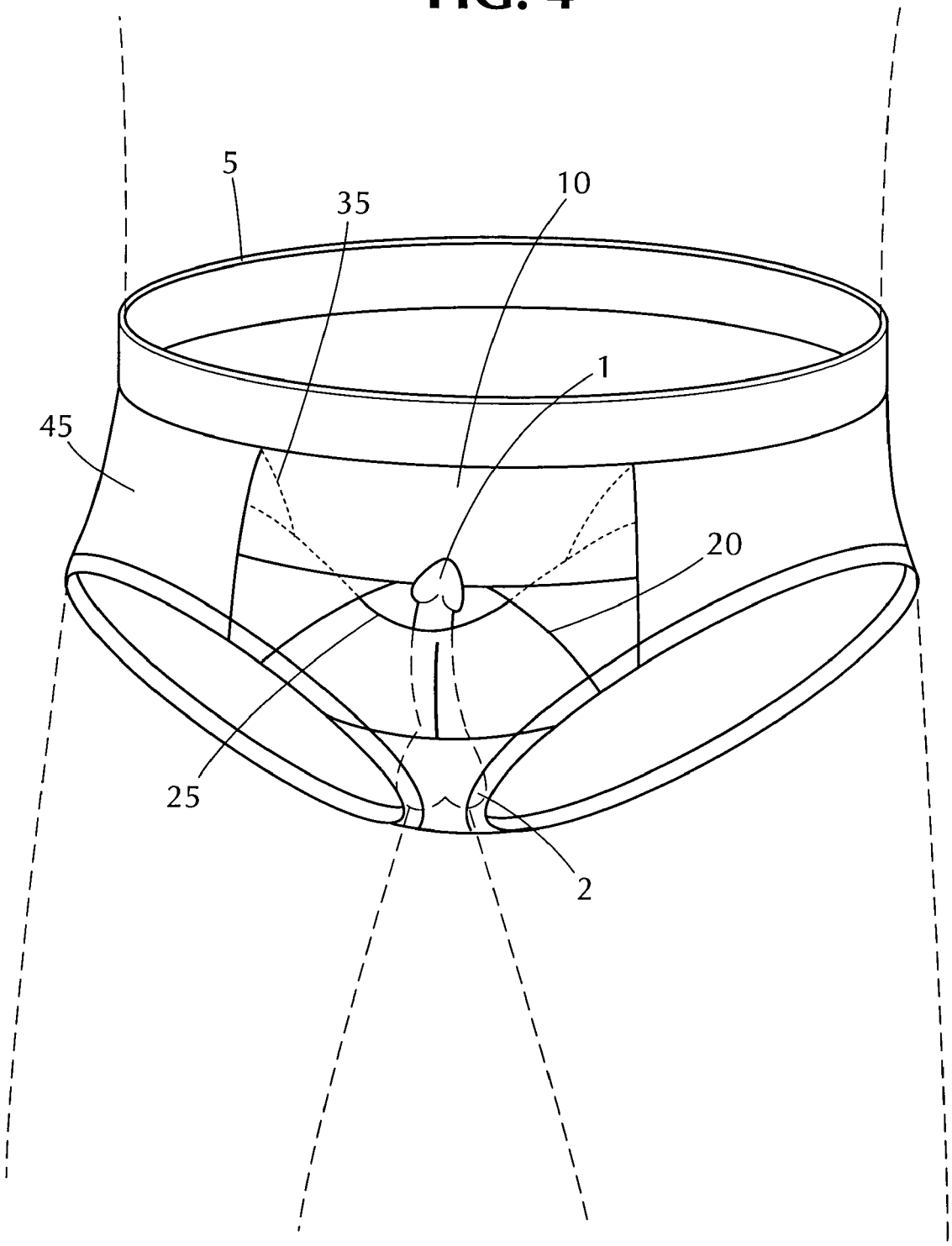
FIG. 4 is a frontal view illustrating the penis being accessed by either a right handed or left handed user for urination.

In the preferred embodiment, the enclosure flap is held in place by a flap retainer 20. The flap retainer 20 is designed to securely prevent the unintentional exposure of the user's penis 1. Another purpose of the flap retainers 20 is to gently secure the penis 1 within the penis enclosure 25. The resistance of the elastic on the retainers are designed for comfortable access to the penis for urination while holding the penis 1 in place securely as shown in FIG. 4. The flap and enclosure retainers can take the form of either a solid piece of elastic fabric or in a string-like form.

Figure 2:
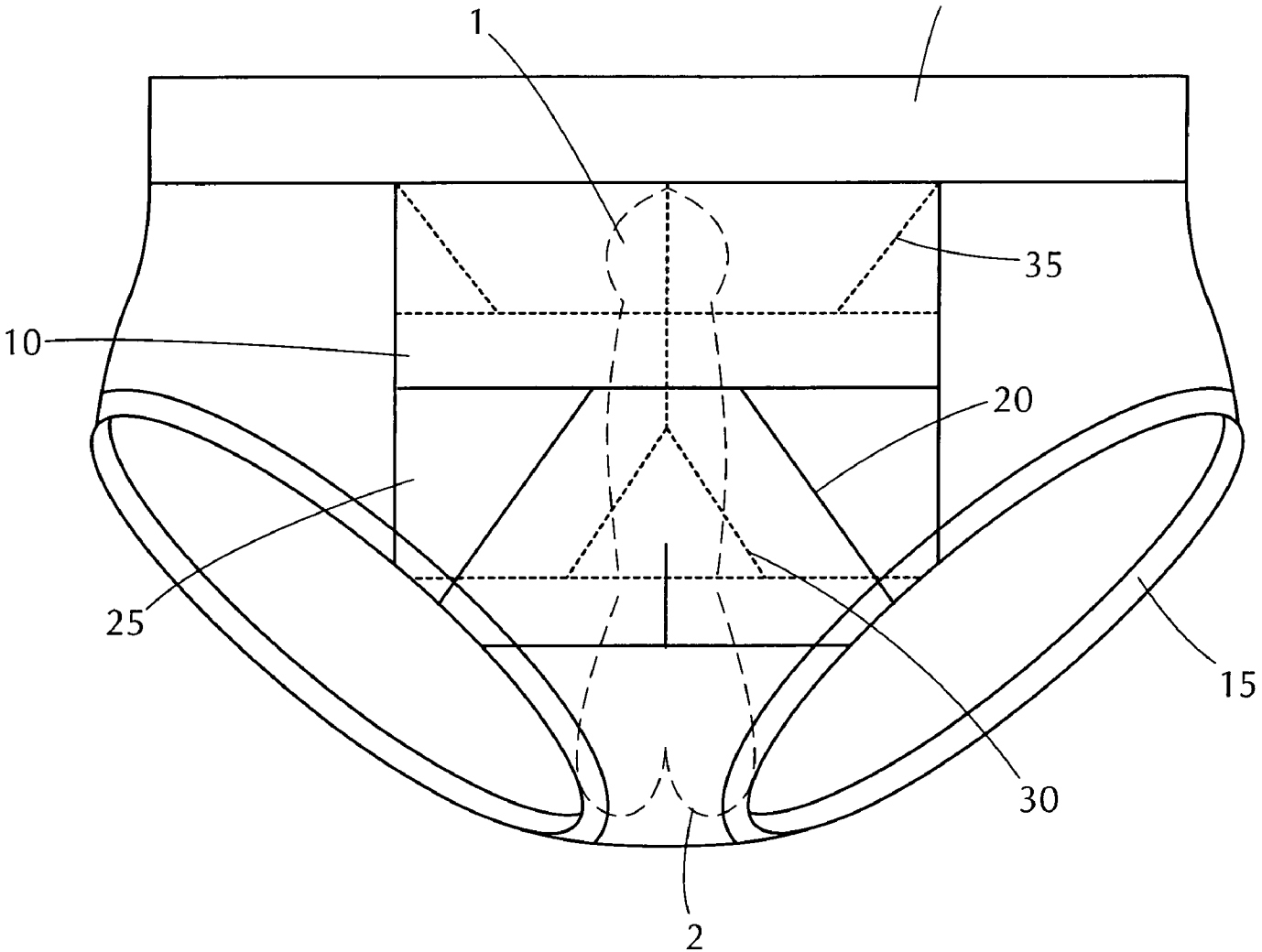
FIG. 2 is a front cross sectional view of the tubular portion shown in FIG. 1 illustrating the penis port for a user's penis to be extended therethrough into the penis enclosure separating the penis from the scrotum.
Figure 3:
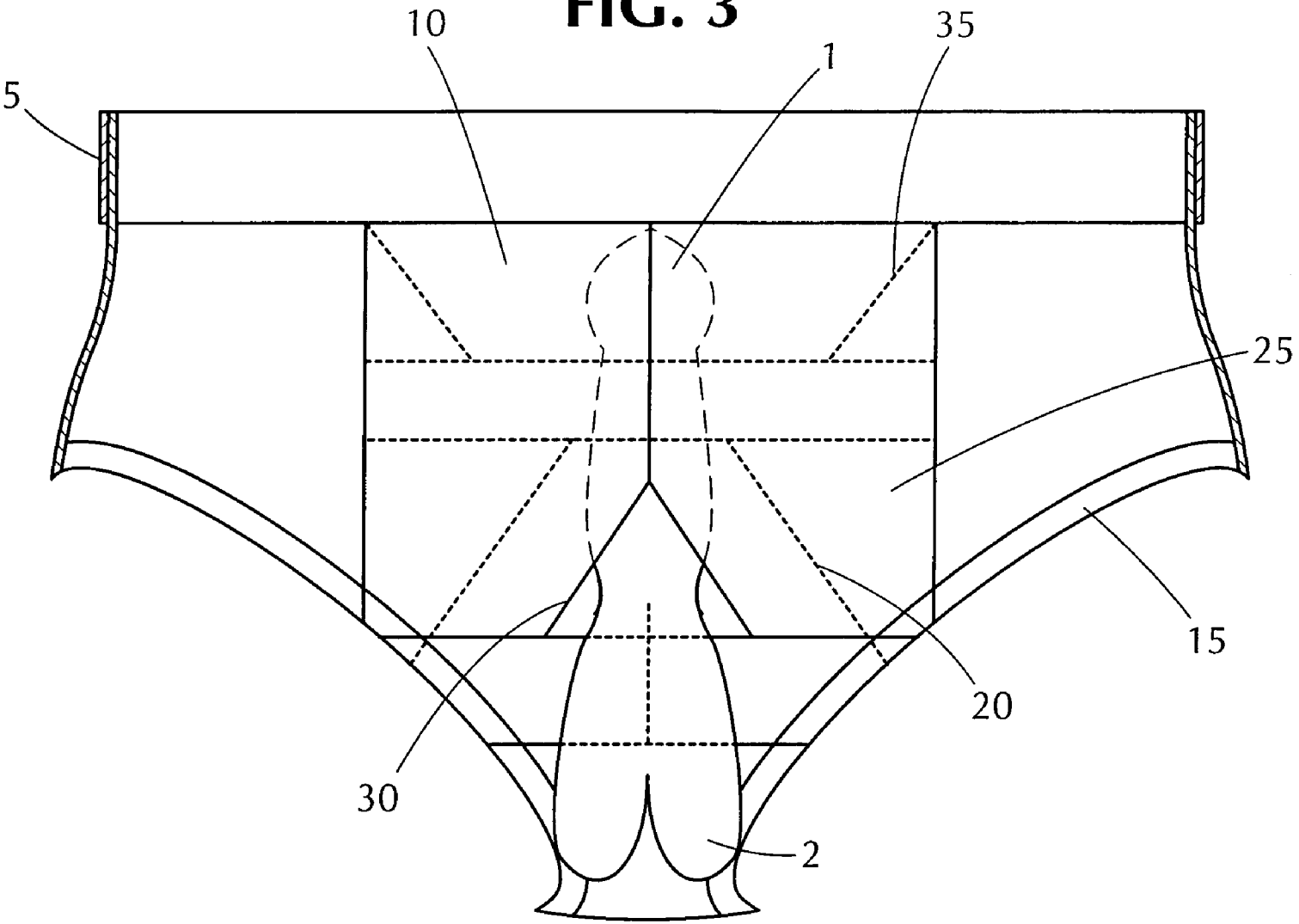
FIG. 3 is a back cross sectional view of the tubular portion shown in FIG. 1 illustrating the penis port for a user's penis to be extended therethrough into the penis enclosure separating the penis from the scrotum.

The user wears the undergarment as commonly known by inserting legs into the leg openings and pulling up the waistband 5 securely onto the hips or waist. In the preferred embodiment, as shown in FIG. 2 and FIG. 3, the user insert his penis 1 into and through the port 30 to ultimately place the penis in the penis enclosure 25 leaving the scrotum in the interior of the tubular body. In the preferred embodiment, the port is shaped substantially as a triangle. The shaped port ensures that there is no unintentional slippage of the penis out of the penis enclosure from the port 30 during normal wear. The scrotum may rest comfortably and securely in the scrotum receiving cradle 50 as shown in FIG. 6.

The penis enclosure 25 is held in place by the enclosure retainers 35. The enclosure retainers 35 prevent the unintentional opening of the penis enclosure exposing the penis. Additionally, the enclosure retainers ensures the penis remains in the penis enclosure. In the preferred embodiment, a horizontal opening is located at the top portion of the penis enclosure. Further the horizontal opening of the penis enclosure is covered by an enclosure flap 10 as shown in FIG. 4. The horizontal opening is designed for easy access for urination for either right handed or left handed users.

Figure 5B:
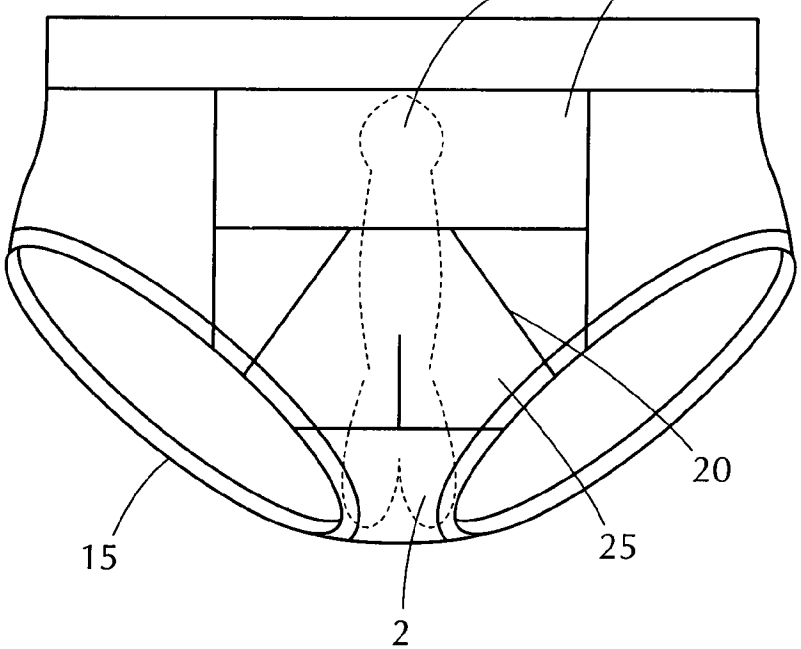
FIG. 5*b* is a front view of the garment illustrating the penis in an erect state being concealed in conjunction with the penis enclosure and the penis enclosure flap.
Figure 5A:
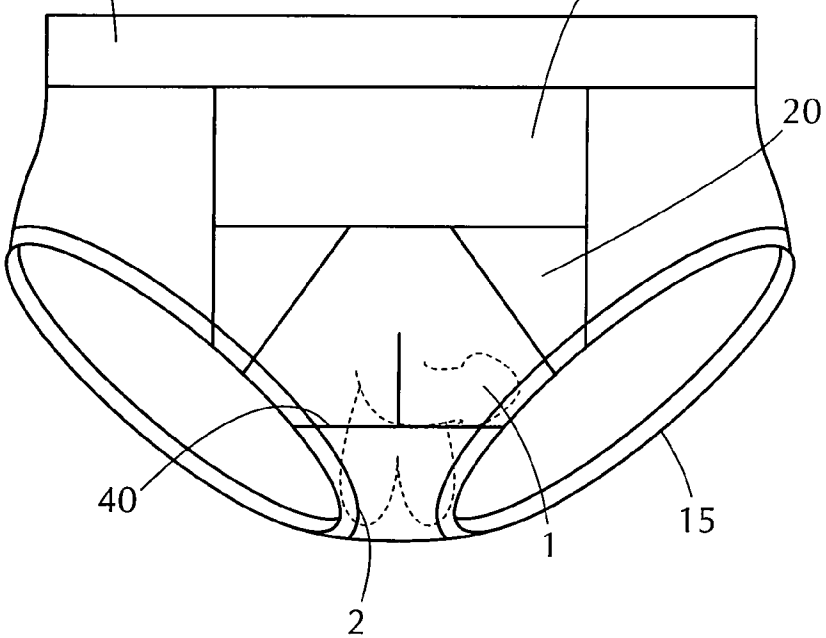
FIG. 5*a* is a front view of the garment illustrating the penis in a flaccid state supported by the bottom portion of the penis enclosure.

Additionally, the invention ensures the comfort of the user, no matter the state of the penis 1. As shown in FIG. 5A and FIG. 5*b*, the penis 1 can either be in erect state or flaccid state without concerning the user on comfort or exposure. The enclosure retainer 35 and flap retainer 20 ensures that the flap and penis enclosure is secured such that at all times fabric from either the enclosure 25 or the flap 10 prevents unintentional exposure of the penis. Comfort of the user is ensured when the penis 1 is in the flaccid state, the penis 1 rest on the lower portion of the penis enclosure 40 as shown in FIG. 5A. Comfort is ensured for the user's penis in the erect state through the use of flexible retainers as shown in FIG. 5B. Additionally, as shown in FIG. 5B unintentional exposure of the penis 1 is prevented by the penis enclosure 25 and the enclosure flap 10.

The undergarment of the present invention as described and illustrated will provide greater comfort by moisture absorption and air circulation than conventional forms of briefs. The garment minimizes binding, pinching, and especially chafing, and at the same time provides anatomically correct freedom for the male genitals but with the additional concealment (modesty) over and beyond that provided by customary briefs, as this invention will totally encase the male genitalia in a pocket preventing the occasional unexpected exposure. Access to the penis may be obtained by simply lifting or moving the penis flap 10 up while pushing the penis enclosure 25 down.

The garment of the present invention may be made entirely of a light mesh knit or woven fabric or parts of the garment may be of knit fabric and other parts of woven fabric. The preferred materials utilized for the present invention is commonly known in the art to facilitate such effects as aeration, absorption of moisture, and quick drying. The brief may also be made in a variety of sizes resulting from variations in the sizes of the various elements including the tubular support body portion 45, elastic leg openings 15, the penis enclosure 25, and the port 30.

Additionally, with the penis and scrotum secured in place the leg openings can afford very lose or non existent elastic.

While the above invention has been described with reference to certain preferred embodiments, the scope of the present invention is not limited to these embodiments. One skilled in the art may find variations of these preferred embodiments which, nevertheless, fall within the spirit of the present invention, whose scope is defined by the claims set forth below

What is claimed is:

1. A male undergarment comprising:

a. A undergarment body comprising the a front, a back, a side, a waistband, a main trunk panel, leg openings, a substantially triangular penis through port, penis enclosure, elastic enclosure retainers, a penis enclosure flap, elastic enclosure flap retainers, and a scrotum receiving cradle;

b. Said main trunk panel comprises the leg openings, the triangular penis through port on the frontal area of the main trunk panel, and a scrotum receiving cradle, located in the lower frontal area of the main trunk panel predefined distant from said penis port;

c. Said scrotum receiving cradle is shaped to nestle the wearer's scrotum comfortably;

d. A penis inserted therethrough the triangular port which is located substantially perpendicularly to the base of the penis into a support pocket formed by the penis enclosure shaped in the form of a comfortable pouch to cradle the penis in its flaccid state, with an opening on the top and the main trunk panel in the front exterior of the main trunk panel further allowing separation from the wearer's scrotum contact with the penis preventing irritation;

e. Said flaccid penis may rest comfortably on the lower horizontal seam of the penis enclosure;

f. Said port is shaped in such a fashion to prevent the penis from unintentionally entering back into the main trunk panel;

g. At least two elastic enclosure retainers diagonally extend from the main trunk panel to the penis enclosure ensuring the shapeliness of the undergarment;

h. Said penis enclosure is horizontally canopied by the penis enclosure flap forming a cover whereby the penis enclosure flap has an upper most portion forming and upper edge and a lower most portion forming a lower edge that is overlapping the penis enclosure, preventing exposure of the penis regardless of state, erect or flaccid, further said penis enclosure is intended to allow top access to the penis for either a right handed or left handed wearer for the ease of urination, and;

i. Said elastic enclosure flap retainers extends from the main trunk panel to the penis enclosure flap ensuring the shapeliness of the undergarment and to prevent the exposure of the penis regardless of state, erect or flaccid.

2. A male undergarment as in claim 1 whereas penis enclosure opening and the enclosure flap is positioned such that a opening created for urination is comfortable for the user being substantially midpoint of the frontal opening of the outer garment.

3. A male undergarment as in claim 1 whereas elastic retainers can either be in the form of a strap or a sheet of material.

4. A male undergarment as in claim 1 whereas elastic retainers are weaker in elastic strength compared to the waistband.

5. A male undergarment comprising:

a. A undergarment body comprising the a front, a back, a side, a waistband, a main trunk panel, leg openings, a shaped penis through port, penis enclosure, elastic enclosure retainers, a penis enclosure flap, elastic enclosure flap retainers, and a scrotum receiving cradle;

b. Said main trunk panel comprises the leg openings, the shaped penis through port on the frontal area of the main trunk panel, and a scrotum receiving cradle, located in the lower frontal area of the main trunk panel predefined distant from said penis port;

c. Said scrotum receiving cradle is shaped to nestle the wearer's scrotum comfortably;

d. A penis inserted therethrough the triangular port which is located substantially perpendicularly to the base of the penis into a support pocket formed by the penis enclosure shaped in the form of a comfortable pouch to cradle the penis in its flaccid state, with an opening on the top and the main trunk panel in the front exterior of the main trunk panel further allowing separation from the wearer's scrotum contact with the penis preventing irritation;

e. Said flaccid penis may rest comfortably on the lower horizontal seam of the penis enclosure;

f. Said port is shaped in such a fashion to prevent the penis from unintentionally entering back into the main trunk panel;

g. At least two elastic enclosure retainers extend diagonally from the main trunk panel to the penis enclosure ensuring the shapeliness of the undergarment;

h. Said penis enclosure is horizontally canopied by the penis enclosure flap forming a cover, whereby the penis enclosure flap has an upper most portion forming and upper edge and a lower most portion forming a lower edge that is overlapping the penis enclosure, preventing exposure of the penis regardless of state, erect or flaccid, further said penis enclosure is intended to allow top access to the penis for either a right handed or left banded wearer for the ease of urination, and;

i. Said elastic enclosure flap retainers extends from the main trunk panel to the penis enclosure flap ensuring the shapeliness of the undergarment and to prevent the exposure of the penis regardless of state, erect or flaccid.

6. A male undergarment as in claim 5 whereas penis enclosure opening and the enclosure flap is positioned such that a opening created for urination is comfortable for the user being substantially midpoint of the frontal opening of the outer garment.

7. A male undergarment as in claim 5 whereas elastic retainers can either be in the form of a strap or a sheet of material.

8. A male undergarment as in claim 5 whereas elastic retainers are weaker in elastic strength compared to the waistband.

9. A male undergarment comprising:

a. A undergarment body comprising the a front, a back, a side, a waistband, a main trunk panel, leg openings, a substantially triangular penis through port, penis enclosure, elastic enclosure retainers, a penis enclosure flap, elastic enclosure flap retainers, and a scrotum receiving cradle;

b. Said main trunk panel comprises the leg openings, the triangular penis through port on the frontal area of the main trunk panel, and a scrotum receiving cradle, located in the lower frontal area of the main trunk panel predefined distant from said penis port;

c. Said scrotum receiving cradle is shaped to nestle the wearer's scrotum comfortably;

d. A penis inserted therethrough the triangular port which is located substantially perpendicularly to the base of the penis into a support pocket formed by the penis enclosure shaped in the form of a comfortable pouch to cradle the penis in its flaccid state, with an opening on the top and the main trunk panel in the front exterior of the main trunk panel further allowing separation from the wearer's scrotum contact with the penis preventing irritation;

e. Said flaccid penis may rest comfortably on the lower horizontal seam of the penis enclosure;

f. Said port is shaped in such a fashion to prevent the penis from unintentionally entering back into the main trunk panel;

g. At least two elastic enclosure retainers extend diagonally from the main trunk panel to the penis enclosure ensuring the shapeliness of the undergarment;

h. Said penis enclosure is horizontally canopied by the penis enclosure flap forming a cover, whereby the penis enclosure flap has an upper most option forming and upper edge and a lower most portion forming a lower edge that is overlapping the penis enclosure, preventing exposure of the penis regardless of state, erect or flaccid, further said penis enclosure is intended to allow top access to the penis for either a right handed or left handed wearer for the ease of urination; and;

i. Said elastic enclosure flap retainers extends from the main trunk panel to the penis enclosure flap ensuring the shapeliness of the undergarment and to prevent the exposure of the penis regardless of state, erect or flaccid, and;

j. Said penis and scrotum firmly positioned such that elastic around the leg openings may be relatively loose or non-existent to ensure wearer comfort.

10. A male undergarment as in claim 9 whereas penis enclosure opening and the enclosure flap is positioned such that a opening created for urination is comfortable for the user being substantially midpoint of the frontal opening of the outer garment.

11. A male undergarment as in claim 9 whereas elastic retainers can either be in the form of a strap or a sheet of material.

12. A male undergarment as in claim 9 whereas elastic retainers are weaker in elastic strength compared to the waistband.

13. A male undergarment comprising:

a. A undergarment body comprising the a front, a back, a side, a waistband, a main trunk panel, leg openings, a substantially triangular penis through port, penis enclosure, elastic enclosure retainers, a penis enclosure flap, and elastic enclosure flap retainers;

b. Said main trunk panel comprises the leg openings, the triangular penis through port on the frontal area of the main trunk panel;

c. A penis inserted therethrough the triangular port which is located substantially perpendicularly to the base of the penis into a support pocket formed by the penis enclosure shaped in the form of a comfortable pouch to cradle the penis in its flaccid state, with an opening on the top and the main trunk panel in the front exterior of the main trunk panel;

d. Said flaccid penis may rest comfortably on the lower horizontal seam of the penis enclosure;

e. Said port is shaped in such a fashion to prevent the penis from unintentionally entering back into the main trunk panel;

f. At least two elastic enclosure retainers diagonally extend from the main trunk panel to the penis enclosure ensuring the shapeliness of the undergarment;

g. Said penis enclosure is horizontally canopied by the penis enclosure flap forming a cover, whereby the penis enclosure flap has an upper most portion forming and upper edge and a lower most portion forming a lower edge that is overlapping the penis enclosure preventing exposure of the penis regardless of state, erect or flaccid, further said penis enclosure is intended to allow top access to the penis for either a right handed or left handed wearer for the ease of urination, and;

h. Said elastic enclosure flap retainers extends from the main trunk panel to the penis enclosure flap ensuring the shapeliness of the undergarment and to prevent the exposure of the penis regardless of state, erect or flaccid.

14. A male undergarment as in claim 13 whereas penis enclosure opening and the enclosure flap is positioned such that a opening created for urination is comfortable for the user being substantially midpoint of the frontal opening of the outer garment.

15. A male undergarment as in claim 13 whereas elastic retainers can either be in the form of a strap or a sheet of material.

16. A male undergarment as in claim 13 whereas elastic retainers are weaker in elastic strength compared to the waistband.

17. A male undergarment comprising:

a. A undergarment body comprising the a front, a back, a side, a waistband, a main trunk panel, leg openings, penis enclosure, elastic enclosure retainers, a penis enclosure flap, elastic enclosure flap retainers, and a scrotum receiving cradle;

b. Said main trunk panel comprises the leg openings, and a scrotum receiving cradle, located in the lower frontal area of the main trunk panel predefined distant from said penis port;

c. Said scrotum receiving cradle is shaped to nestle the wearer's scrotum comfortably;

d. A penis inserted therethrough the triangular port into a support pocket formed by the penis enclosure with an opening on the top and the main trunk panel in the front exterior of the main trunk panel further allowing separation from the wearer's scrotum contact with the penis preventing irritation;

e. Said penis may rest comfortably on the lower horizontal seam of the penis enclosure;

f. Said port is shaped in such a fashion to prevent the penis from unintentionally entering back into the main trunk panel;

g. Said elastic enclosure retainers extend from the main trunk panel to the penis enclosure ensuring the shapeliness of the undergarment;

h. Said penis enclosure is horizontally canopied by the penis enclosure flap preventing exposure of the penis regardless of state, erect or flaccid, further said penis enclosure is intended to allow top access to the penis for either a right handed or left handed wearer for the ease of urination, and;

i. Said elastic enclosure flap retainers extends from the main trunk panel to the penis enclosure flap ensuring the shapeliness of the undergarment and to prevent the exposure of the penis regardless of state, erect or flaccid.

18. A male undergarment as in claim 17 whereas penis enclosure opening and the enclosure flap is positioned such that a opening created for urination is comfortable for the user being substantially midpoint of the frontal opening of the outer garment.

19. A male undergarment as in claim 17 whereas elastic retainers can either be in the form of a strap or a sheet of material.

20. A male undergarment as in claim 17 whereas elastic retainers are weaker in elastic strength compared to the waistband.

21. A male swimsuit comprising:

a. A undergarment body comprising the a front, a back, a side, a waistband, a main trunk panel, leg openings, a substantially triangular penis through port, penis enclosure, elastic enclosure retainers, a penis enclosure flap, elastic enclosure flap retainers, and a scrotum receiving cradle;

b. Said main trunk panel comprises the leg openings, the triangular penis through port on the frontal area or the main trunk panel, and a scrotum receiving cradle, located in the lower frontal area of the main trunk panel predefined distant from said penis port;

c. Said scrotum receiving cradle is shaped to nestle the wearer's scrotum comfortably;

d. A penis inserted therethrough the triangular port which is located substantially perpendicularly to the base of the penis into a support pocket formed by the penis enclosure shaped in the form of a comfortable pouch to cradle the penis in its flaccid state, with an opening on the top and the main trunk panel in the front exterior of the main trunk panel further allowing separation from the wearer's scrotum contact with the penis preventing irritation;

e. Said port is shaped in such a fashion to prevent the penis from unintentionally entering back into the main trunk panel;

f. At least two elastic enclosure retainers extend from the main trunk panel to the penis enclosure ensuring the shapeliness of the undergarment;

g. Said penis enclosure is horizontally canopied by the penis enclosure flap forming a cover, whereby the penis enclosure flap has an upper most portion forming and upper edge and lower most portion forming a lower edge that is overlapping the penis enclosure, preventing exposure of the penis regardless of state, erect or flaccid, further said penis enclosure is intended to allow top access to the penis for either a right banded or left banded wearer for the ease of urination;

h. Said elastic enclosure flap retainers extends from the main trunk panel to the penis enclosure flap ensuring the shapeliness of the undergarment and to prevent the exposure of the penis regardless of state, erect or flaccid, and;

i. Said swimsuit is constructed of materials which are water resistant.

22. A male undergarment as in claim 1 whereas penis enclosure opening and the penis enclosure flap is positioned such that a opening created for urination is comfortable for the user being substantially midpoint from the waistband to the bottom-most portion of said swimwear.

23. A male undergarment as in claim 1 whereas elastic retainers can either be in the form of a strap or a sheet of material.

24. A male undergarment as in claim 1 whereas elastic retainers are weaker in elastic strength compared to the waistband.

g. At least two elastic retainers extend from the main trunk panel to the penis enclosure ensuring the shapeliness of the undergarment;

h. Said penis enclosure is horizontally canopied by the penis enclosure flap form a cover, whereby the penis enclosure flap has an upper most portion forming and upper edge and a lower most portion forming a lower edge that is overlapping the penis enclosure, preventing exposure of the penis regardless of state, erect or flaccid, further said penis enclosure is intended to allow top access to the penis for either a right handed or left handed wearer for ease of urination, and;

i. Said elastic enclosure flap retainers extend from the main trunk panel to the penis enclosure flap ensuring the shapeliness of the undergarment and to prevent exposure of the penis regardless of state, erect or flaccid.

25. A male undergarment comprising:

a. A undergarment body comprising a front, a back, a side, a waistband, a main trunk panel, leg openings, a substantially triangular penis through port, penis enclosure, elastic enclosure retainers, a penis enclosure flap, elastic enclosure flap retainers, and a scrotum receiving cradle;

b. Said main trunk panel comprises the leg openings, the triangular penis through port on the frontal area of the main trunk panel, and a scrotum receiving cradle, located in the lower frontal area of the main trunk panel predefined distant from the penis port;

c. Said scrotum receiving cradle is shaped to nestle the wearer's scrotum comfortably;

d. A penis inserted therethrough the triangular port which is located substantially perpendicularly to the base of the penis into a support pocket formed by the penis enclosure shaped in the form of a comfortable pouch to cradle the penis in its flaccid state, with an opening on the top and the main trunk panel in the front exterior of the main trunk panel further allowing separation from the wearer's scrotum contact with the penis preventing irritation;

e. Said flaccid penis may rest comfortably on the lower horizontal seam of the penis enclosure;

f. Said port is shaped in such a fashion to prevent the penis from unintentionally entering back into the main trunk panel;

g. At least two elastic retainers extend from the main trunk panel to the penis enclosure ensuring the shapeliness of the undergarment;

h. Said penis enclosure is horizontally canopied by the penis enclosure flap form a cover whereby the penis enclosure flap has an upper most portion forming and upper edge and a lower most portion forming a lower edge that is overlapping the penis enclosure, preventing exposure of the penis regardless of state, erect or flaccid, further said penis enclosure is intended to allow top access to the penis for either a right handed or left handed wearer for ease of urination, and;

i. Said elastic enclosure flap retainers extend from the main trunk panel to the penis enclosure flap ensuring the shapeliness of the undergarment and to prevent exposure of the penis regardless of state, erect or flaccid.

* * * * *